US005674163A

United States Patent [19]

Sennett

[11] Patent Number: 5,674,163

[45] Date of Patent: Oct. 7, 1997

[54] EXERCISE DEVICE

[76] Inventor: Louis W. Sennett, 10003 N. Holmes Ct., Mequon, Wis. 53092

[21] Appl. No.: 689,350

[22] Filed: Aug. 8, 1996

[51] Int. Cl.[6] ..... A63B 21/02

[52] U.S. Cl. ..... 482/125; 482/907; 482/131

[58] Field of Search ..... 482/121, 122, 482/124, 125, 907, 131, 140, 79, 80

[56] References Cited

U.S. PATENT DOCUMENTS

| | | | |
|---|---|---|---|
| D. 209,759 | 1/1968 | Snyder . | |
| 1,706,654 | 3/1929 | Christesen | 482/125 |
| 1,801,769 | 4/1931 | Gartner | 482/79 |
| 1,952,750 | 3/1934 | Gailey | 482/125 |
| 2,340,666 | 2/1944 | Johanson | 482/79 |
| 3,068,002 | 12/1962 | Balne . | |
| 3,068,003 | 12/1962 | Portman et al. . | |
| 3,119,614 | 1/1964 | Berry . | |
| 3,672,361 | 6/1972 | Fourneron . | |
| 3,734,493 | 5/1973 | Hasekian . | |
| 4,079,933 | 3/1978 | Everroad . | |
| 4,195,835 | 4/1980 | Hinds et al. | 482/125 |
| 4,653,747 | 3/1987 | Newcomer . | |
| 4,735,412 | 4/1988 | Psala . | |
| 5,122,107 | 6/1992 | Gardiner . | |
| 5,342,274 | 8/1994 | Hunker . | |
| 5,372,566 | 12/1994 | Olschansky et al. . | |
| 5,480,369 | 1/1996 | Dudley | 482/125 |

FOREIGN PATENT DOCUMENTS

| | | | |
|---|---|---|---|
| 556672 | 12/1974 | Switzerland | 482/125 |

*Primary Examiner*—Lynne A. Reichard

*Attorney, Agent, or Firm*—Andrus, Sceales, Starke & Sawall

[57] ABSTRACT

An exercise device that can be used to increase cardiovascular conditioning and weight reduction, primarily through the strengthening of the abdominal muscles. The exercise device includes a foot retaining member having a pair of foot straps. The foot retaining member and foot straps retain and hold the user's feet in contact with the foot retaining member during the exercise movement. A pair of adjustable side straps extend from the ends of the foot retaining member and are adjustably connected to a handle. Preferably, the pair of side straps and the pair of foot straps are constructed of a single piece of material. When the foot retaining member is positioned on the user's feet, the user grasps the handle and begins the exercising movement. By moving his or her legs from an upright position to a generally seated position, the user can exercise his or her abdominal muscles without exerting stress on his or her back or neck muscles.

3 Claims, 2 Drawing Sheets

EXERCISE DEVICE

FIELD OF THE INVENTION

The invention relates to a portable exercise device. More specifically, the invention relates to an exercise device which can be used to exercise the abdominal muscles of a user while reducing the stress on the lower back and neck.

BACKGROUND OF THE INVENTION

Exercise has long been known to be an effective way to facilitate weight reduction. However, many obese patients are unable to do any form of significant exercise because of their excessive weight, shortness of breath, heel spurs, painful hips and knees, and their simple sedentary habits. Simple exercises, such as walking, are often times painful or inconvenient, and expensive exercise equipment like treadmills may not be available or feasible.

Although many prior art exercise systems are known, many of these systems work on the principal of resistive isometric effort; that is, making a muscle or group of muscles work against a stationary or fixed resistance. While this type of exercise is useful in increasing muscle mass and muscle strength, resistive isometric exercise can be injurious for some patients. Additionally, isometric devices are not as effective in improving cardiac conditioning or in the utilization of calories with sustained effort.

Simple, non-impact types of exercise, such as sit ups and leg elevations, are often recommended to increase the consumption of fat and improve cardiac conditioning. However, many overweight or obese people who have led a sedentary life are unable to raise their legs up off a table or perform a situp due to their weakness and weight. Besides overly obese persons, individuals who have chronic back difficulties, people with weak abdominal muscles from inactivity, abdominal surgery, recent postpartum status, or large abdomens because of fatness often have great difficulty in performing a simple situp movement.

Therefore, it can be appreciated that an exercise device which aids in the performing of a situp-like movement, while reducing the strength requirement to initially perform the situp movement, would be desirable. In particular, a device which is easy to use and simple in construction which can effectively exercise the abdominal muscles to aid in cardiovascular conditioning and weight reduction would be particularly desirable.

SUMMARY OF THE INVENTION

The invention is an exercise device that can be used to increase cardiovascular conditioning and weight reduction while reducing the amount of strength needed to initially perform the exercise.

The exercise device includes a foot retaining member that engages the feet of a user. The foot retaining member preferably has a pair of foot straps that aid in retaining the user's feet in contact with the foot retaining member.

The exercise device further includes a handle which extends between a first and second end. The handle is connected to the foot retaining member by a pair of adjustable side straps that extend between the two ends of the handle and spaced ends of the foot retaining member. In a preferred embodiment of the invention, the pair of adjustable side straps and the pair of foot straps are formed from a single strip of material. Preferably, the material is non-flexible, such that the distance between the foot retaining member and the handle remains constant once the pair of side straps are adjusted.

To use the device, the user initially begins in a supine position in which the knees are bent. The user then positions the foot retaining member in contact with his or her feet and uses the foot straps to securely hold the foot retaining member in place. The side straps of the exercise device are positioned to the outside of the user's bent knees and the side straps adjusted such that the handle is positioned slightly past the thigh of the user. With the exercise device in position, the user grasps the handle with his or her hands and straightens his or her legs while raising them to an upright position. From this position, the user lowers his or her feet while moving his or her torso into a generally sitting upright position. By repeating this movement, the user can effectively exercise his or her abdominal muscles while at the same time using other muscles in the arms and back to provide a cardiovascular workout and increase the body's caloric consumption to aid in the weight reduction process.

There are other features, objects and advantages of the invention which will be made apparent from the following description taken together with the drawings.

BRIEF DESCRIPTION OF THE DRAWINGS

The drawings illustrate the best mode presently contemplated for carrying out the invention.

In the drawings.

DETAILED DESCRIPTION OF THE DRAWINGS

Figure 1:
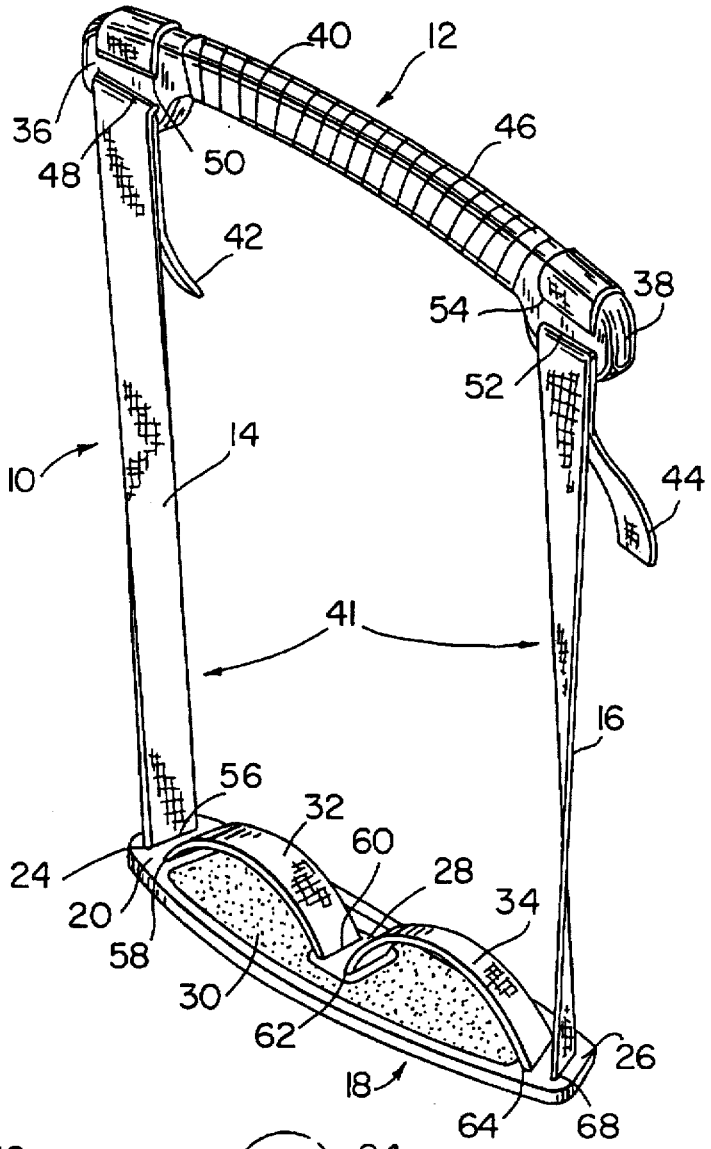
FIG. 1 is an isometric view of the exercise device of the invention.
Figure 3:
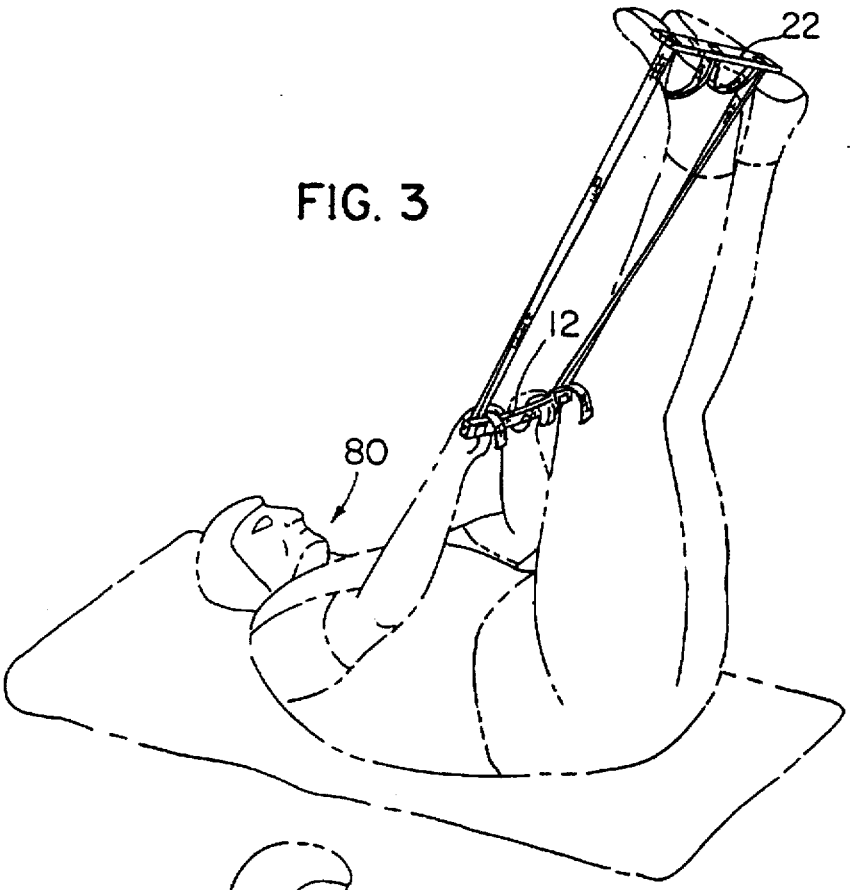
FIG. 3 is a view showing the exercise device as used by a person showing the position of the legs before they are lowered as part the exercise movement.

Referring to FIG. 1, the exercise device constructed according to the invention is generally designated by reference numeral 10. The exercise device 10 generally consists of a handle 12, a pair of side straps 14, 16, and a foot retaining member 18. The foot retaining member 18 is preferably a generally flat, plate-like member having a front surface 20 and a back surface 22 (FIG. 3). The foot retaining member 18 extends between a first end 24 and a second end 26 and contains a central portion 28 positioned therebetween. A gripping element 30, such as a piece of readily available adhesive backed, anti-slip sheet material, is affixed to the front surface 20 of the foot retaining member 18.

A pair of foot straps 32 and 34 are connected to the foot retaining member 18. As shown in FIG. 1, the foot strap 32 extends between the first end 24 and the central portion 28 of the foot retaining member 18, while the second foot strap 34 extends between the second end 26 and the central portion 28 of the foot retaining member 18.

As is clearly shown in FIG. 1, the first side strap 14 extends between the first end 24 of the foot retaining member 18 and the first end 36 of the handle 12. The second side strap 16 extends between the second end 26 of the foot retaining member 18 and the second end 38 of the handle 12. The handle 12 further includes a gripping portion 40 that extends between the first end 36 and the second end 38. The handle 12 is preferably bowed outward between the first end 36 and the second end 38 in order to better facilitate gripping by a user of the exercise device 10. As shown in FIG. 1, the gripping portion 40 of the handle 12 can be wrapped with strip-like padding and gripping material which defines a series of gripping lines 46, to increase the ability of a user to grip the handle 12 without slipping. In the preferred embodiment of the invention, the length of the handle 12 and the length of the foot retaining member 18 are generally equal. The handle 12 and the foot retaining member 18 can be formed from a variety of materials, such as plastic in the preferred embodiment, as long as the material has sufficient strength to resist bending during usage.

Each of the side straps 14, 16 terminate in an end portion 42 and 44, respectively. The side straps 14, 16 can be mounted to the handle 12 in a variety of manners, provided that the length of each side strap 14, 16 between the handle and the foot retaining member is adjustable, as will be better understood in the following description.

In the preferred embodiment of the invention, the pair of side straps 14, 16 and the pair of foot straps 32, 34 are formed from a single strip of material 41 extending between the end portion 42 and the end portion 44. The single strip of material 41 can be selected from a variety of different materials, such as a woven nylon strap. However, the single strip of material 41 should be durable enough to resist fraying when a pulling force is applied to the handle 12 and the foot retaining member 18 is held in place.

To facilitate the length adjustment, the end portion 42 is interwoven through a pair of slots 48, 50 forward in and extending laterally through the first end 36 of the handle 12. The length of the side strap 14 can be adjusted by feeding the strap through the pair of slots 48, 50 and varying the amount of material extending from the slot 48 to the end portion 42. Likewise, a pair of slots 52, 54 are formed in an extend laterally through the second end 38 of the handle 12, such that the length of the side strap 16 can be adjusted by varying the amount of material between the end portion 44 and the handle 12.

Referring now to FIGS. 1 and 3, the single strip of material 41 forms the side strap 14 and is threaded through a series of slots 56–68 formed in foot retaining member 18 to form the pair of foot straps 32, 34. The single strip of material 41 then continues to form side strap 16 and passes through the second end of the handle 12, as previously described. The single strip of material 41 is interconnected with the handle 12 and foot retaining member 18 to form the side straps 14, 16 and foot straps 32, 34 as follows. The strip of material 41 extends from the first end 42 through the slots 48 and 50 in the handle 12 to a position where it forms side strap 14. The side strap 14 extends downwardly through slot 56, and up through slot 58 to form the foot strap 32. The foot strap 32 then extends downwardly through slot 60 and up through slot 62 to form foot strap 34. Foot strap 34 extends downwardly through slot 64 and up through slot 68 where it becomes side strap 16. The side strap 16 is interwoven through the slots 52, 54 in handle 12 and terminates at end portion 44.

Although the exercise device 10 has been described as containing a single strip of material 41 which forms the pair of side straps 14, 16 and the pair of foot straps 32, 34, it is within the scope of the invention to provide an exercise device 10 in which the side straps 14, 16 and foot straps 32, 34 are each formed from an individual strip of material. In this alternate embodiment, each of the side straps 14, 16 and the foot straps 32, 34 would be securely affixed to the foot retaining member 18 in any known manner.

Additionally, although the method of adjustment of the length of the side straps 14, 16 has been described as threading the straps through slots contained in handle 12, other methods of modifying the length of the straps between the foot retaining member 18 and the handle 12 can be employed while operating under the scope of the invention. For example, in an alternate embodiment, each of the side straps 14, 16 could include a buckle or bracket through which the straps 14, 16 could be threaded, and the length adjusted thereby. While this alternate embodiment would allow the length of the straps to be adjusted, the embodiment shown in FIG. 1 is the most preferred embodiment since it requires the least number of parts while effectively allowing the length of the straps 14, 16 to be easily adjusted by the user.

Figure 2:
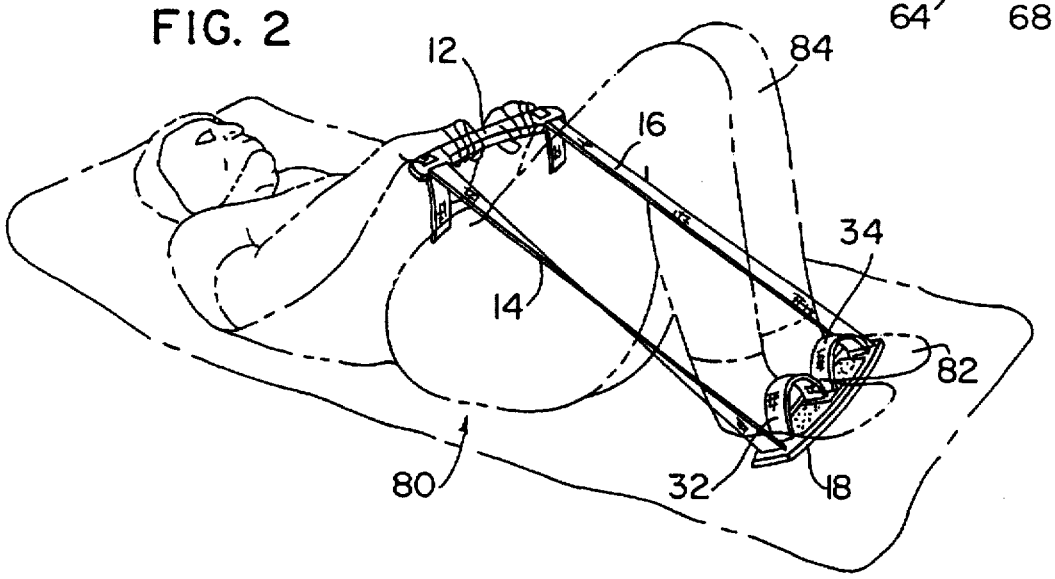
FIG. 2 is a view showing the exercise device being used by a person in the initial position before beginning the exercise movement.

Referring now to FIGS. 2–5, the method of using the exercise device 10 by a person wishing to reduce his or her weight and increase their cardiac conditioning will now be described. Shown in FIG. 2 is a person 80 resting in a supine position on a generally flat planar surface, such as the floor. In this position, the user first inserts his or her feet 82 into the pair of foot straps 32, 34. The user's feet 82 engage the gripping element 30 contained on the front surface 20 of the foot retaining member 18.

With the user's feet 82 securely positioned on the foot retaining member 18, the user bends his or her knees 84 upward to raise the feet upwardly to the position shown in FIG. 2. With his or her knees 84 in this position, the side straps 14, 16 are each positioned to the outside of the user's legs. The user 80 then positions the handle 12 across his or her thighs and adjusts the length of the side straps 14, 16 until the handle 12 is located slightly away from the thigh area. With the length of the straps 14, 16 properly adjusted, the user grasps the handle 12 as shown in FIG. 2, such that the handle is positioned slightly away from the user's thighs.

Once the user's feet are positioned within the foot straps 32, 34 and the side straps 14, 16 have been adjusted, the user straightens his or her legs and brings them into an upright position while maintaining his or her grasp on the handle 12, as shown in FIG. 3. In this position, the user can exert a pulling force on the handle 12 with his or her arms to aid in arriving at the position shown in FIG. 3. The side straps 14, 16 are formed of a nonflexible material such that the pulling force applied to handle 12 is transferred to the foot retaining member 18 to aid the user in holding the position shown in FIG. 3.

Figure 4:
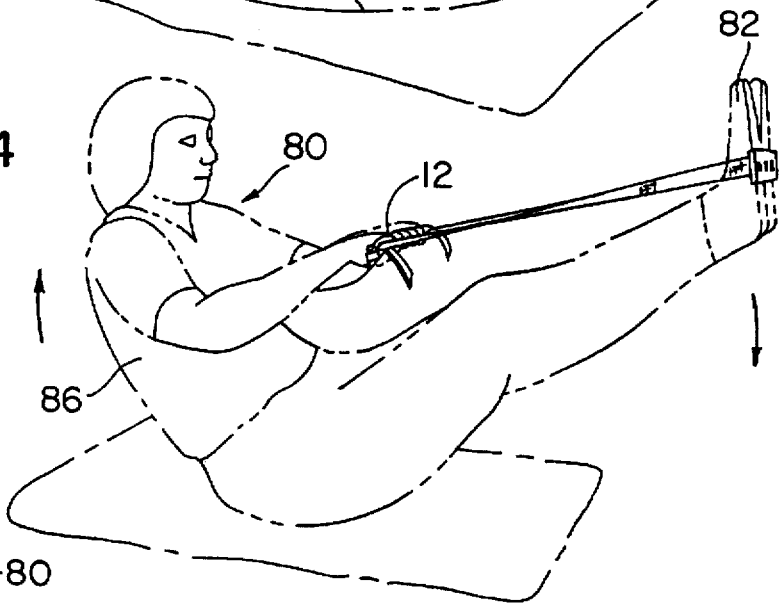
FIG. 4 is a view showing the exercise device as used by a person in the intermediate stage of lowering the legs as part of the exercise movement.

Once in the position shown in FIG. 3, the user then lowers his or her feet 82 while raising his or her torso 86 as shown by the arrows in FIG. 4. This "rocking" movement by the user 80 causes the user's stomach muscles to contract, providing the desired exercise. The rocking movement previously described provides an exercise similar to a sit-up while reducing the stress on the user's back and neck.

While the exercise movement previously described performed in conjunction with the exercise device 10 is effective to tone abdominal muscles, other muscles also play an important role in the exercise. For example, the muscles of the forearm, the biceps, the trapezius muscles, the pectorals, the thighs, the quadricep muscles and the major and minor gluteus muscles are all used to perform the exercise movement. The use of all these muscles contribute to improving oxygen utilization to make them more efficient and increase cardiac conditioning. Additionally, the use of all these muscles consume calories to aid in weight reduction.

Figure 5:
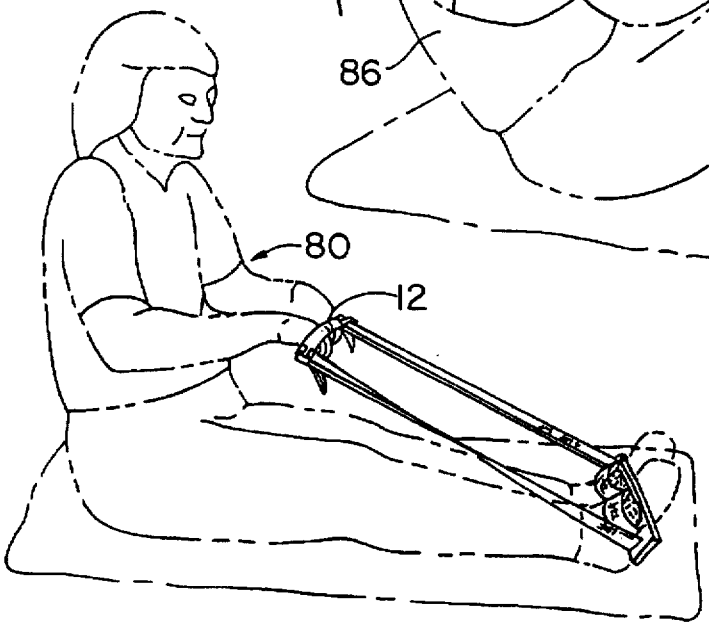
FIG. 5 is a view of the exercise device as used by a person in the completed stage of the exercise movement.

After completing the rocking movement, the user 80 finishes the exercise in the position shown in FIG. 5. From this position, the user then rocks backward, assumes the position of FIG. 1, and repeats the described movement a series of times to provide the desired exercise effect.

It is thought that the present invention and its advantages will be understood from the foregoing description, the form of the invention described above being merely a preferred or exemplary embodiment of the invention. It may be apparent that various changes can be made without departure from the spirit and scope of the invention and sacrificing all of its material advantages.

I claim:

1. A method of exercising the abdominal muscles of a person comprising the steps of:

providing a foot retaining member to engage the person's feet;

retaining the person's feet on the foot retaining member by a pair of foot straps;

providing a handle affixed to the foot retaining member by a pair of adjustable side straps;

positioning each of the side straps to the outside of the person's legs;

adjusting the length of the side straps such that the handle is engageable by the person's hands;

raising the person's legs to a generally vertical position while the person maintains a supine position; and lowering the person's legs to a generally horizontal position while pulling on the handle, causing the person to move into a generally upright seated position.

2. The method of claim 1 wherein the foot straps and the side straps are a single contiguous structure.

3. The method of claim 1 wherein the handle contains a series of slots, and wherein the step of adjusting the length of the side straps is carried out by moving the side straps within the series of slots.

* * * * *